US007549906B2

(12) United States Patent
Bedford et al.

(10) Patent No.: US 7,549,906 B2
(45) Date of Patent: Jun. 23, 2009

(54) TOY PLAY SET WITH MOVING PLATFORM

(75) Inventors: Jonathan Bedford, Hawthorne, CA (US); Eric So, Tsing Yi (HK)

(73) Assignee: Mattel, Inc., El Segundo, CA (US)

( * ) Notice: Subject to any disclaimer, the term of this patent is extended or adjusted under 35 U.S.C. 154(b) by 440 days.

(21) Appl. No.: 11/333,988

(22) Filed: Jan. 17, 2006

(65) Prior Publication Data

US 2006/0286897 A1 Dec. 21, 2006

Related U.S. Application Data

(60) Provisional application No. 60/691,465, filed on Jun. 16, 2005.

(51) Int. Cl.
*A63H 18/00* (2006.01)

(52) U.S. Cl. ..... 446/444; 104/54

(58) Field of Classification Search ..... 446/288, 446/444–447, 168–174; 238/10 E, 10 R, 238/10 A; 104/54, 60; 414/227, 230, 234–235, 414/241, 253, 258, 598, 599

See application file for complete search history.

(56) References Cited

U.S. PATENT DOCUMENTS

| | | | | |
|---|---|---|---|---|
| 985,880 | A * | 3/1911 | Badisco | 104/54 |
| 1,367,417 | A * | 2/1921 | Beresford | 104/54 |
| 1,506,771 | A | 9/1924 | O'Leary | |
| 2,239,395 | A | 4/1941 | Mallory | |
| 2,392,722 | A | 1/1946 | Burlin | |
| 3,126,670 | A | 3/1964 | Smith | |
| 3,299,565 | A | 1/1967 | Yarashes | |

(Continued)

FOREIGN PATENT DOCUMENTS

| | | |
|---|---|---|
| CA | 2396567 | 7/2001 |

(Continued)

OTHER PUBLICATIONS

Canadian Office Action mailed Dec. 7, 2007 for Canadian application No. 2,525,039.

(Continued)

*Primary Examiner*—Gene Kim
*Assistant Examiner*—Alyssa M Hylinski
(74) *Attorney, Agent, or Firm*—Kolisch Hartwell, P.C.

(57) ABSTRACT

The present disclosure is directed to a toy play set for use with a toy vehicle comprising a platform attached to a support structure. In some examples, the play set may include a base and a support structure pivotally attached to the base with the support structure adapted to pivot relative to the base. In other examples, the toy play set may include a platform pivotally attached to the support structure and adapted to rotate in a toy vehicle's direction of travel. In still other examples, the toy play set may include first and second elongate tracks and means for carrying a toy vehicle from the first elongate track to the second elongate track. One disclosed embodiment includes first and second elongate tracks, a base, a support structure pivotally attached to the base, a platform pivotally attached to the support structure wherein the platform and support structure pivot at perpendicular axes that are parallel to the ground, and a vehicle receiving apparatus attached to the second elongate track.

27 Claims, 10 Drawing Sheets

U.S. PATENT DOCUMENTS

| | | | | | |
|---|---|---|---|---|---|
| 3,308,575 | A | | 3/1967 | Lemelson | |
| 3,451,161 | A | | 6/1969 | Lemelson | |
| 3,480,210 | A | | 11/1969 | Perrinjaquiet | |
| 3,494,070 | A | | 2/1970 | Lemelson | |
| 3,518,789 | A | | 7/1970 | Domashovetz | |
| 3,531,119 | A | | 9/1970 | Bonanno | |
| 3,600,849 | A | * | 8/1971 | Faller | 446/429 |
| 3,633,308 | A | | 1/1972 | Yang | |
| 3,656,586 | A | | 4/1972 | Robson | |
| 3,665,636 | A | | 5/1972 | Benson et al. | |
| 3,690,393 | A | * | 9/1972 | Guy | 180/65.6 |
| 3,707,805 | A | | 1/1973 | Buck | |
| 3,751,847 | A | | 8/1973 | Neuhierl | |
| 3,797,164 | A | | 3/1974 | Glass | |
| 3,953,938 | A | | 5/1976 | Kilgore | |
| 4,045,908 | A | * | 9/1977 | Ensmann et al. | 446/441 |
| 4,068,392 | A | | 1/1978 | Montgomery | |
| 4,068,402 | A | * | 1/1978 | Tanaka | 446/445 |
| 4,087,935 | A | | 5/1978 | Edmisson et al. | |
| 4,091,995 | A | | 5/1978 | Barlow et al. | |
| 4,106,695 | A | | 8/1978 | Carella et al. | |
| 4,128,964 | A | * | 12/1978 | Ogasawara | 446/171 |
| 4,185,409 | A | * | 1/1980 | Cheng | 446/487 |
| 4,221,076 | A | * | 9/1980 | Ozawa | 446/445 |
| 4,241,534 | A | | 12/1980 | Larsson et al. | |
| 4,254,576 | A | * | 3/1981 | Matsumoto et al. | 446/444 |
| 4,266,769 | A | | 5/1981 | Saitoh | |
| 4,312,149 | A | * | 1/1982 | Iwao | 446/269 |
| 4,312,151 | A | | 1/1982 | Orenstein | |
| 4,333,261 | A | | 6/1982 | Jones et al. | |
| 4,386,777 | A | | 6/1983 | Prehodka | |
| 4,459,438 | A | | 7/1984 | Kaiser | |
| 4,468,031 | A | | 8/1984 | Barlow et al. | |
| 4,519,789 | A | | 5/1985 | Halford | |
| 4,536,168 | A | | 8/1985 | Stephens | |
| 4,536,169 | A | | 8/1985 | Fekete et al. | |
| 4,661,080 | A | | 4/1987 | Goldstein et al. | |
| 4,697,812 | A | | 10/1987 | Rudell et al. | |
| 4,940,444 | A | | 7/1990 | Russell | |
| 4,961,716 | A | * | 10/1990 | Hippely et al. | 446/75 |
| 4,979,926 | A | | 12/1990 | Bisceglia | |
| 4,990,117 | A | | 2/1991 | Yonezawa | |
| 5,038,685 | A | * | 8/1991 | Yoneda et al. | 104/54 |
| 5,052,972 | A | | 10/1991 | Suimon et al. | |
| 5,080,627 | A | | 1/1992 | Oriya et al. | |
| 5,165,347 | A | | 11/1992 | Wagner | |
| 5,342,048 | A | | 8/1994 | Jones et al. | |
| 5,452,893 | A | | 9/1995 | Faulk et al. | |
| 5,601,490 | A | | 2/1997 | Nakagawa et al. | |
| 5,678,489 | A | | 10/1997 | Wang | |
| 5,683,298 | A | | 11/1997 | Jackson | |
| 5,855,501 | A | * | 1/1999 | Kato et al. | 446/171 |
| 5,865,661 | A | | 2/1999 | Cyrus et al. | |
| 5,890,945 | A | | 4/1999 | Asami et al. | |
| 5,931,714 | A | | 8/1999 | Johnson | |
| 5,974,977 | A | | 11/1999 | Johnson et al. | |
| 6,093,079 | A | | 7/2000 | House | |
| 6,173,654 | B1 | * | 1/2001 | Ngai | 104/295 |
| 6,193,581 | B1 | | 2/2001 | Wiggs et al. | |
| 6,341,564 | B1 | * | 1/2002 | Ochi | 104/53 |
| 6,343,972 | B1 | | 2/2002 | Ogawa et al. | |
| 6,422,151 | B2 | | 7/2002 | Maleika | |
| 6,478,654 | B1 | | 11/2002 | Rehkemper et al. | |
| 6,482,070 | B2 | | 11/2002 | Hogan | |
| 6,508,179 | B2 | | 1/2003 | Annis et al. | |
| 6,602,107 | B1 | | 8/2003 | Hogan | |
| 6,676,480 | B2 | | 1/2004 | Sheltman | |
| 6,764,376 | B2 | | 7/2004 | Agostini | |
| 6,805,609 | B1 | | 10/2004 | Paukert | |
| 2003/0224697 | A1 | | 12/2003 | Sheltman et al. | |
| 2005/0176338 | A1 | | 8/2005 | Delaney | |
| 2006/0141902 | A1 | | 6/2006 | Sinisi | |

FOREIGN PATENT DOCUMENTS

| | | | | |
|---|---|---|---|---|
| DE | 3240712 | | | 11/1982 |
| DE | 3409975 | | | 3/1984 |
| DE | 3240712 | | | 5/1984 |
| DE | 3500533 | | | 1/1985 |
| DE | 3409975 | | | 9/1985 |
| DE | 3500533 | | | 7/1986 |
| DE | 3625667 | | | 7/1986 |
| DE | 3628961 | | | 8/1986 |
| DE | 3625667 | | | 1/1987 |
| DE | 3628961 | | | 11/1987 |
| DE | 3941093 | | | 12/1989 |
| DE | 3941093 | | | 6/1991 |
| EP | 0091971 | | | 3/1982 |
| EP | 0091971 | | | 10/1983 |
| EP | 0200837 | | | 12/1985 |
| EP | 0105058 | | | 12/1987 |
| EP | 0280496 | | | 2/1988 |
| EP | 1120144 | | | 12/2000 |
| GB | 0477953 | | | 7/1936 |
| GB | 1380660 | | | 1/1975 |
| GB | 2123704 | | | 2/1984 |
| GB | 2180768 | | | 9/1986 |
| GB | 2230467 | | | 3/1990 |
| JP | 06081504 | A | * | 3/1994 |
| WO | 0123058 | | | 4/2001 |
| WO | 2004016333 | | | 2/2004 |

OTHER PUBLICATIONS

Rev-Ups Skyway Stunt Set, 12 sheets total, comprising: (A) Fall 2004 Mattel Toy Sell Sheets, cover page and p. 39 showing Rev-Ups Skyway Stunt Set (2 sheets); (B) Photographs showing product packaging (2 sheets); and photographs showing the product (8 sheets). The Rev-Ups Skyway Stunt Set was publicly disclosed in the Toy Sell Sheets in the fall of 2004.

Moon Adventure toy play set, sold by Guangdong Auldey Toy Industry Ltd of Guangdong, China, package shows a 2004 copyright notice, 6 sheets total, comprising: (A) photographs of the package for the toy playset (2 sheets) and (B) photographs of the toy playset (4 sheets).

U.S. Patent and Trademark Office, Office action for U.S. Appl. No. 11/334,180, mailing date Apr. 9, 2008, 12 pages. The '180 application has the same inventors as the present '988 application.

U.S. Patent and Trademark Office, Office action for U.S. Appl. No. 11/333,987, mailing date Sep. 11, 2008, 9 pages. The '987 application has the same inventors as the present '988 application.

Division of Patents of the Mexican Institute of Industrial Property, Office Action for Mexican patent application No. PA/a/2005/011764 (which corresponds to U.S. Appl. No. 11/333,988), dated Aug. 26, 2008, seven pages total. The disclosure includes the Spanish-language Office action plus a partial English-language translation prepared by our Mexican agent.

Canadian Intellectual Property Office, Office Action for Canadian patent application No. 2,525,022 (which has the same inventors as U.S. Appl. No. 11/333,988), dated Nov. 27, 2008, three pages total. Applicants concurrently disclose CA 2,396,567 (national phase of WO 2001/51155) cited in this Office action.

* cited by examiner

TOY PLAY SET WITH MOVING PLATFORM

RELATED APPLICATION

This application claims the benefit of U.S. Provisional Application No. 60/691,465 filed on Jun. 16, 2005, Mexican Application No. 2005/011764, filed Nov. 1, 2005 of the same title, and Canadian Application No. 2,525,039, filed Nov. 1, 2005 of the same title, which are incorporated herein by reference for all purposes.

BACKGROUND

Toy play sets and accompanying toy vehicles are a source of entertainment to persons using them. Toy play sets can include track sections and apparatuses that guide the motion of one or more toy vehicles. Various types of motion are possible on a toy play set including linear and rotational motion. Different toy vehicle propulsion means can be used with toy play sets, such as storing energy for propulsion in the vehicle, drawing energy for propulsion from an external power source, or manually propelling the vehicle. Toy vehicles may maintain contact with a play set due to gravity, magnetic forces, and/or mechanical attachment of the toy vehicle to the play set.

The following are prior examples of toy play sets that are incorporated here by reference for all purposes: U.S. Pat. Nos. 2,239,395, 3,126,670, 3,299,565, 3,665,636, 3,690,393, 3,797,164, 4,068,402, 4,087,935, 4,185,409, 4,221,076, 4,254,576, 4,468,031, 4,519,789, 4,536,168, 4,661,080, 4,697,812, 4,979,926, 5,052,972, 5,452,893, 5,601,490, 5,678,489, 5,865,661, 5,890,945, 6,193,581, 6,478,654, 6,508,179, 6,676,480, RE32,106 and U.S. Publication No. 2003/0224697.

SUMMARY

The present disclosure is directed to a toy play set for use with a toy vehicle comprising a platform attached to a support structure. In some examples, the toy play set may include a base and a support structure pivotally attached to the base with the support structure adapted to pivot relative to the base. In some examples, the toy play set may include a platform pivotally attached to the support structure and adapted to rotate in a toy vehicle's direction of travel. In some examples, the toy play set may include first and second elongate tracks and means for rotating a toy play set component to allow a toy vehicle to travel from the first elongate track to the second elongate track.

BRIEF DESCRIPTION OF THE DRAWINGS

This disclosure will become better understood with regard to the following description, appended claims, and accompanying drawings where:

DETAILED DESCRIPTION

A toy play set may entertain persons using the toy play set. It can provide entertainment by facilitating movement of a toy vehicle thereon or by moving the toy vehicle itself. A toy play set may facilitate movement of a toy vehicle thereon by including one or more vehicle support surfaces for a toy vehicle to travel upon. Alternatively, instead of the toy vehicle moving relative to the toy play set, the toy play set may move while supporting the toy vehicle.

Motion of a toy vehicle may occur by a variety of propulsion means. Toy vehicle propulsion means can include storing energy for propulsion in the vehicle, drawing energy for propulsion from an external power source, or manually propelling the vehicle. Storing energy in a toy vehicle may occur by electrically or mechanically storing energy. For example, energy can be stored electrically by charging a battery on a toy vehicle or energy can be stored mechanically by spinning an inertial flywheel. A toy vehicle may have a different speeds and may change speeds selectively while moving on a toy play set.

A toy play set may include a support structure and a platform assembly for use with a toy vehicle. Such a toy play set may include one or more movement mechanisms for moving the support structure or the platform assembly. Movement may occur with multiple degrees of freedom including in a linear fashion along an x-axis, a y-axis, and/or a z-axis. Optionally, movement may occur in a rotational fashion, such as about one or more of an x-axis, a y-axis, a z-axis, and/or an axis traverse to one or more these axes. In other examples, movement may be rectilinear, curvilinear, or both linear and rotational.

Rotational motion may be angularly limited or unlimited. Rotation of 360° about an axis may occur or rotation may stop before or after reaching 360°. For example, rotation may stop after 180° or 90° or 1° and anywhere in-between. Optionally, rotation may occur about different axes and different rotation angles may occur at each axis. Further optionally, different components may rotate about different axes and with different rotation angles.

A movement mechanism may comprise an arcing mechanism for moving a platform assembly along an arc. Alternatively, a movement mechanism may comprise an inversion mechanism for inverting the platform assembly. The toy play set may include one or more arcing mechanisms independent of an inversion mechanism, or it may include one or more inversion mechanisms independent of an arcing mechanism, or it may include one or more of an arcing mechanism and an inversion mechanism in combination. Many variations of such play sets may be envisioned. For example, for the purpose of increasing the level of enjoyment a person may derive from playing with a toy play set, a plurality of movement mechanisms may be included.

Figure 1:
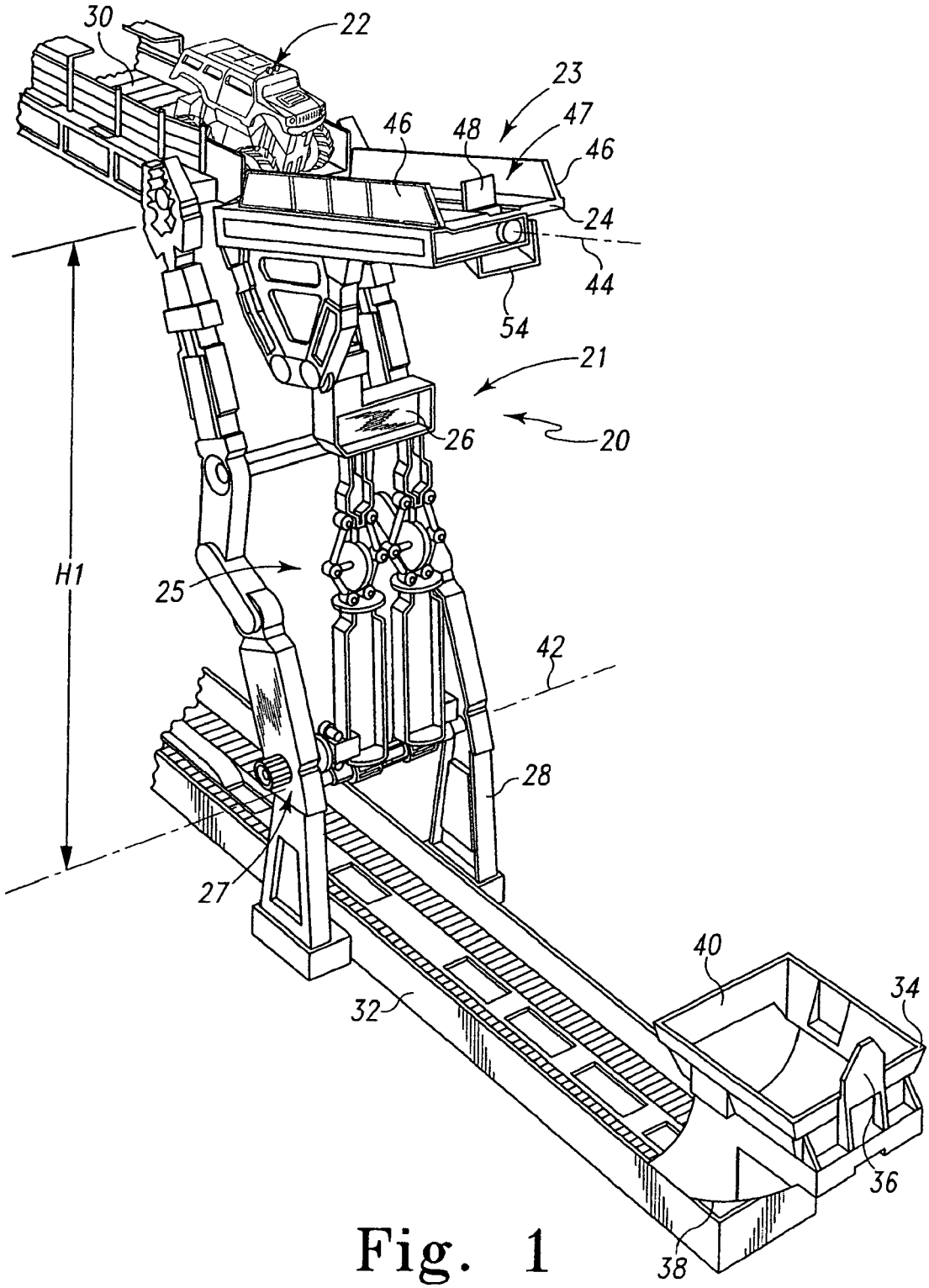
FIG. 1 is a perspective view of a toy play set and a toy vehicle thereon.
Figure 2:
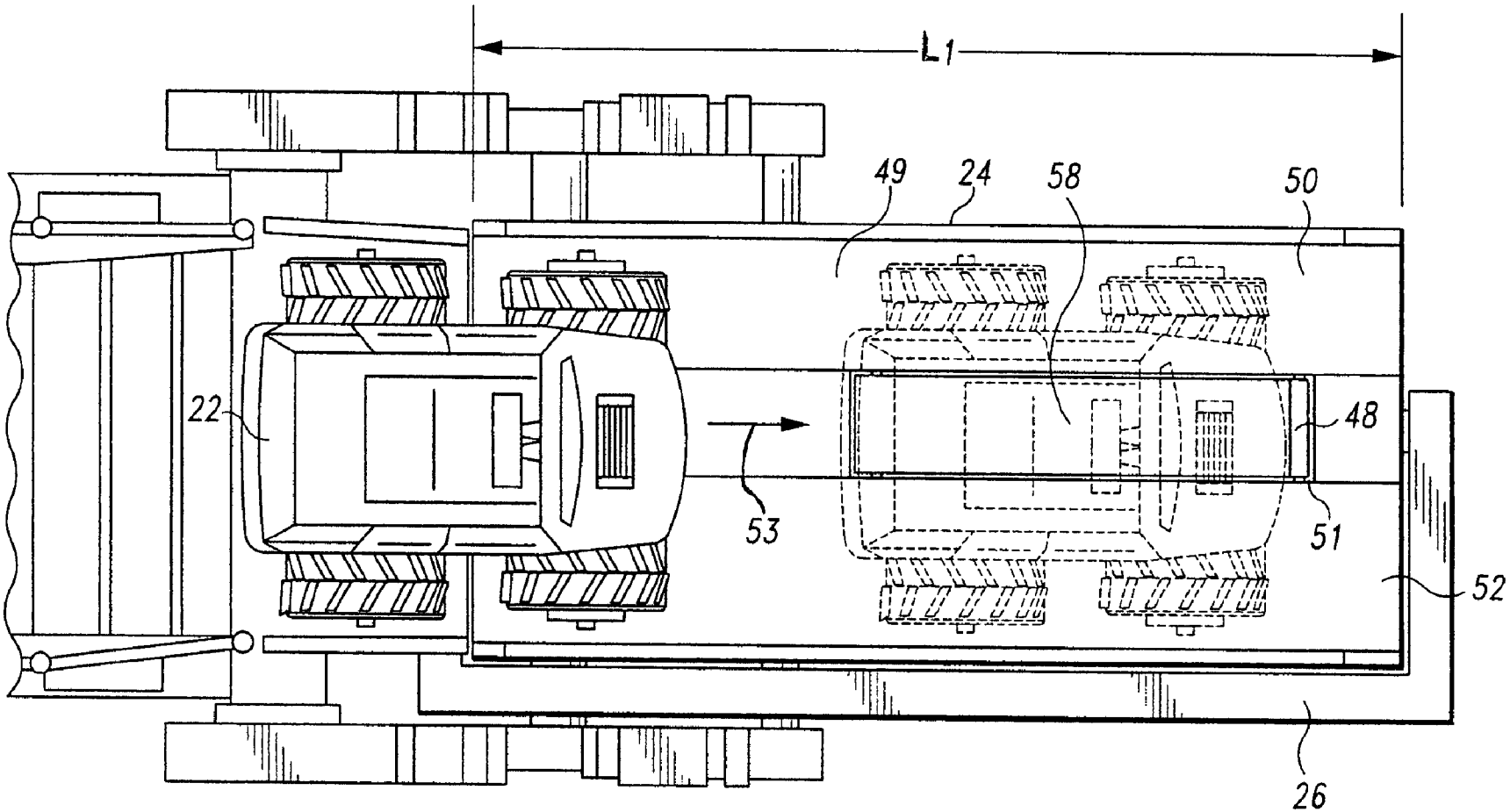
FIG. 2 is a top view of a platform of the toy play set of FIG. 1.
Figure 4A:
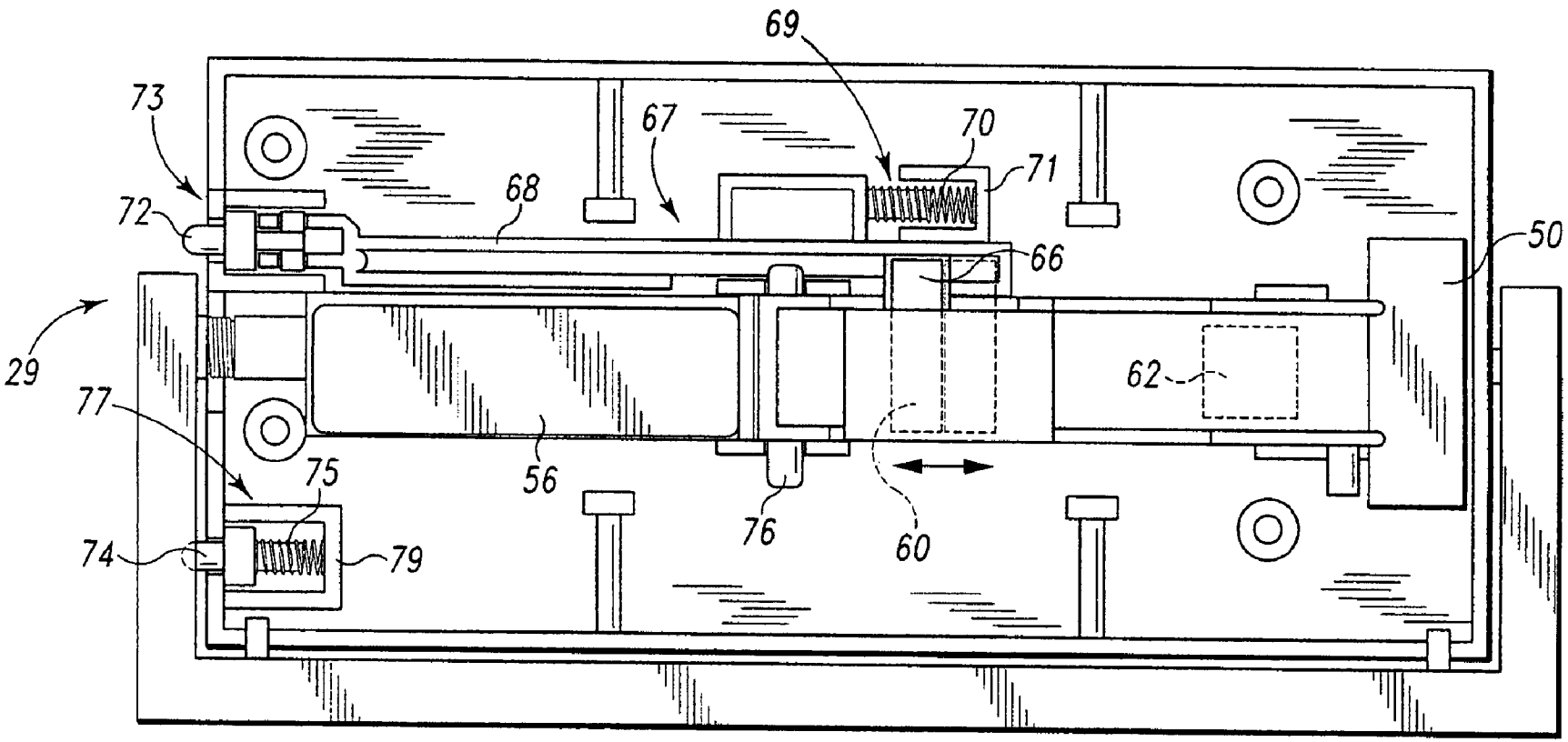
FIG. 4A is a bottom view of the platform of FIG. 3 with a bottom cover removed.
Figure 4B:
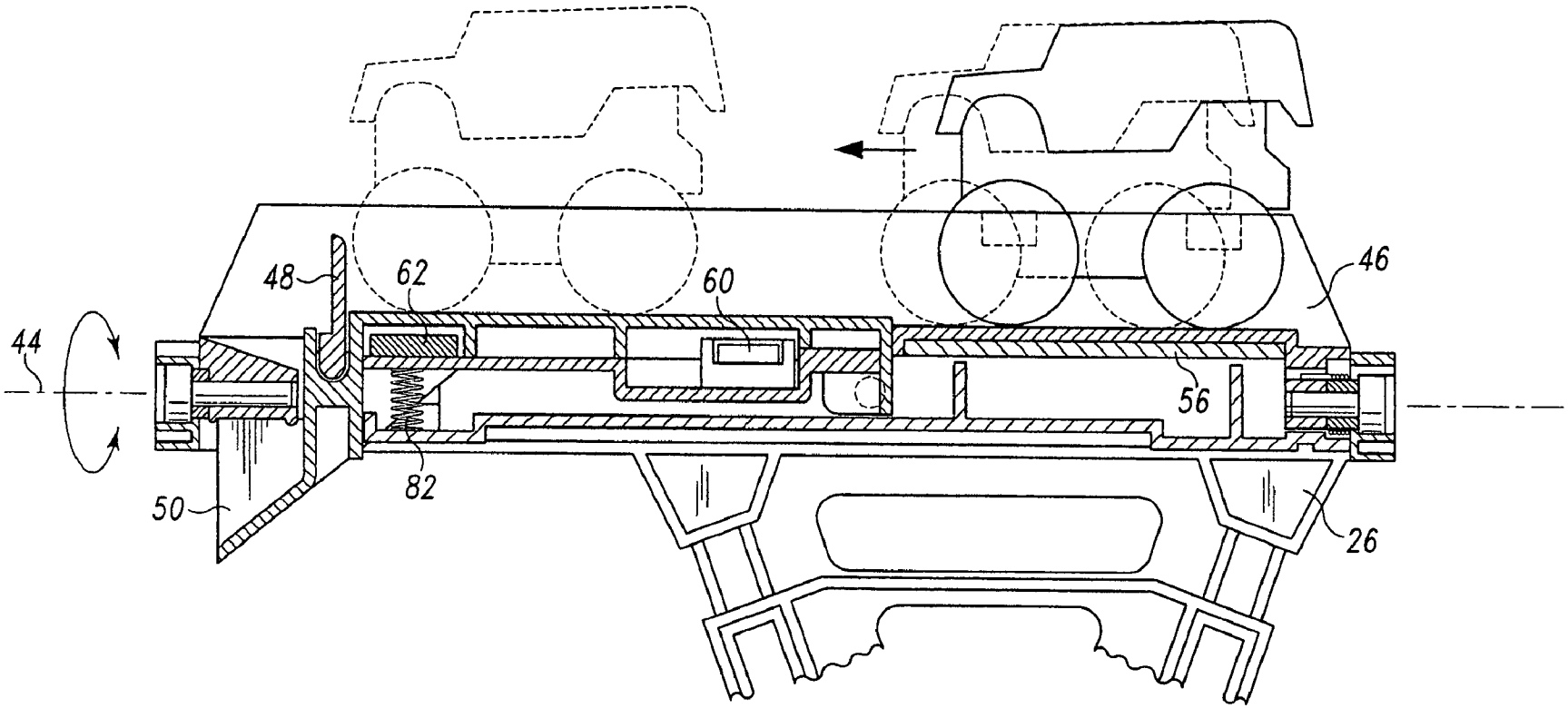
FIG. 4B is a cross sectional view of the platform of FIG. 3 taken along a line 4B-4B bisecting the length of the platform.

One example of a toy play set 20 having movement mechanisms 21 is illustrated in FIG. 1. The toy play set 20 may include a movement mechanism comprising an inversion mechanism 23 and a movement mechanism, such as an arcing mechanism 25. However, other examples of the toy play set 20 may include an arcing mechanism 25 without an inversion mechanism 23, or an inversion mechanism 23 without an arcing mechanism 25. The inversion mechanism 23 may comprise a platform assembly 24 pivotally attached to the support structure 26 at a platform axis 44. The inversion mechanism 23 may further include an inversion retention mechanism 29, which is depicted in FIG. 4A. The arcing mechanism 25 may be adapted to move a platform assembly 24 along an arc. The arcing mechanism 25 may comprise a support structure 26 pivotally attached to a base 28 at an arc axis 42 spaced from the platform assembly 24. The arcing mechanism 25 may further include arc retention mechanism 27.

Inversion mechanism 23 may include a platform assembly 24 having a vehicle support surface 49. The vehicle support surface 49 may define a plane on which a toy vehicle 22 can travel. The vehicle support surface 49 may include a left wheel lane 50 and a right wheel lane 52 on opposite sides of a void 51 in the vehicle support surface. The platform assembly may include a metallic strip 56 imbedded in the vehicle support surface 49, which may interact with a toy vehicle 22 optionally including magnetic elements. The platform assembly may include walls 46 projecting normally from lateral edges the vehicle support surface 49. The vehicle support surface 49 may define a direction of travel, represented by arrow 53, for a toy vehicle 22. The direction of travel, represented by arrow 53, is the path a toy vehicle 22 follows when entering the platform assembly 24 at a trailing edge of the vehicle support surface 49 and traveling across the vehicle support surface 49 to a leading edge of the vehicle support surface 49.

The platform assembly 24 may include a gateway mechanism 47 toward the leading edge of the platform. The gateway mechanism 47 may include a stop member 48 attached to the platform assembly 24. The stop member 48 may be adapted to project from the vehicle support surface 49 and stop a toy vehicle 22 traveling along the vehicle support surface 49. The gateway mechanism 47 may stop the toy vehicle 22 indefinitely or temporarily. When stopping the toy vehicle temporarily, the gateway mechanism 47 may stop the toy vehicle 22 for a certain time or until the toy vehicle 22 is moved to a certain position by the toy play set 20. Alternatively, the gateway mechanism 47 may include a stop member 48 attached to a movable member, such as a magnetic strip 58 pivotally attached to the platform assembly 24. A magnetic strip 58 may comprise a ferromagnetic material, a single magnet, or multiple magnets, such as a first magnet 60 and a second magnet 62. The magnetic strip 58 may interact with a magnetically attractable elements optionally included in a toy vehicle 22, for example the second magnet 62 may hold a toy vehicle in place on the vehicle support surface 49 against the force of gravity when the platform 24 is in an inverted orientation.

The gateway mechanism 47 may include a void 51 in the vehicle support surface 49 configured to receive the magnetic strip 58 as it pivots relative to the vehicle support surface 49 at hinge 76. The gateway mechanism 47 may be adapted to pivot the stop member 48 between a stopping position above the vehicle support surface 49 and a passage position below the vehicle support surface 49. The gateway mechanism 47 may include a first biasing member 82 adapted to bias the magnetic strip 58 into the stopping position wherein the stop member 48 projects from the vehicle support surface 49.

Figure 3:
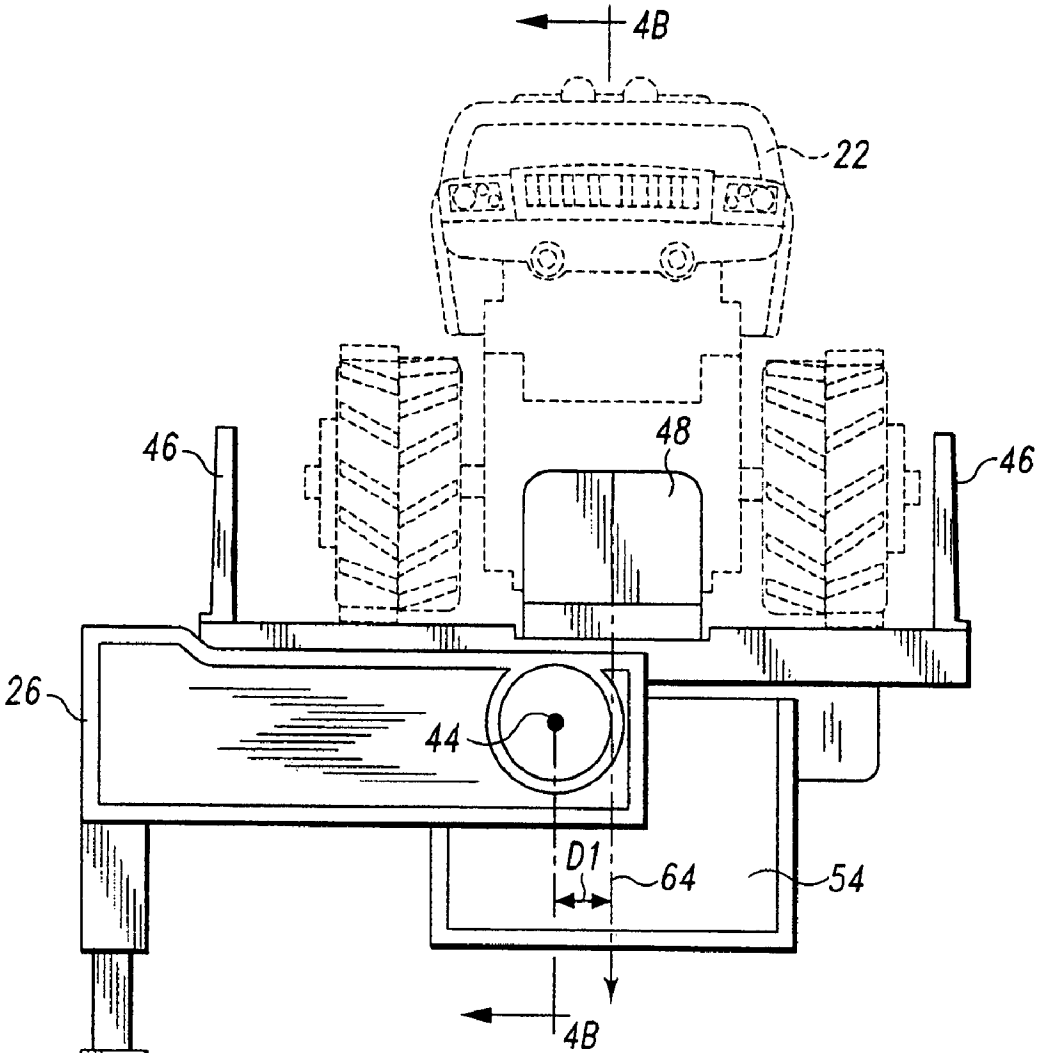
FIG. 3 is a leading edge view of the platform of FIG. 2 and a toy vehicle thereon.

The platform assembly 24 may have a center of gravity 64 offset from the center of the vehicle-support-surface width by a dimension D1 as depicted in FIG. 3. The platform assembly 24 may be configured such that the center of gravity 64 remains offset when a toy vehicle 22 is present on the vehicle support surface 49. The offset center of gravity 64 may cause the platform assembly 24 to rotate about the platform axis 44 unless otherwise inhibited.

Figure 5:
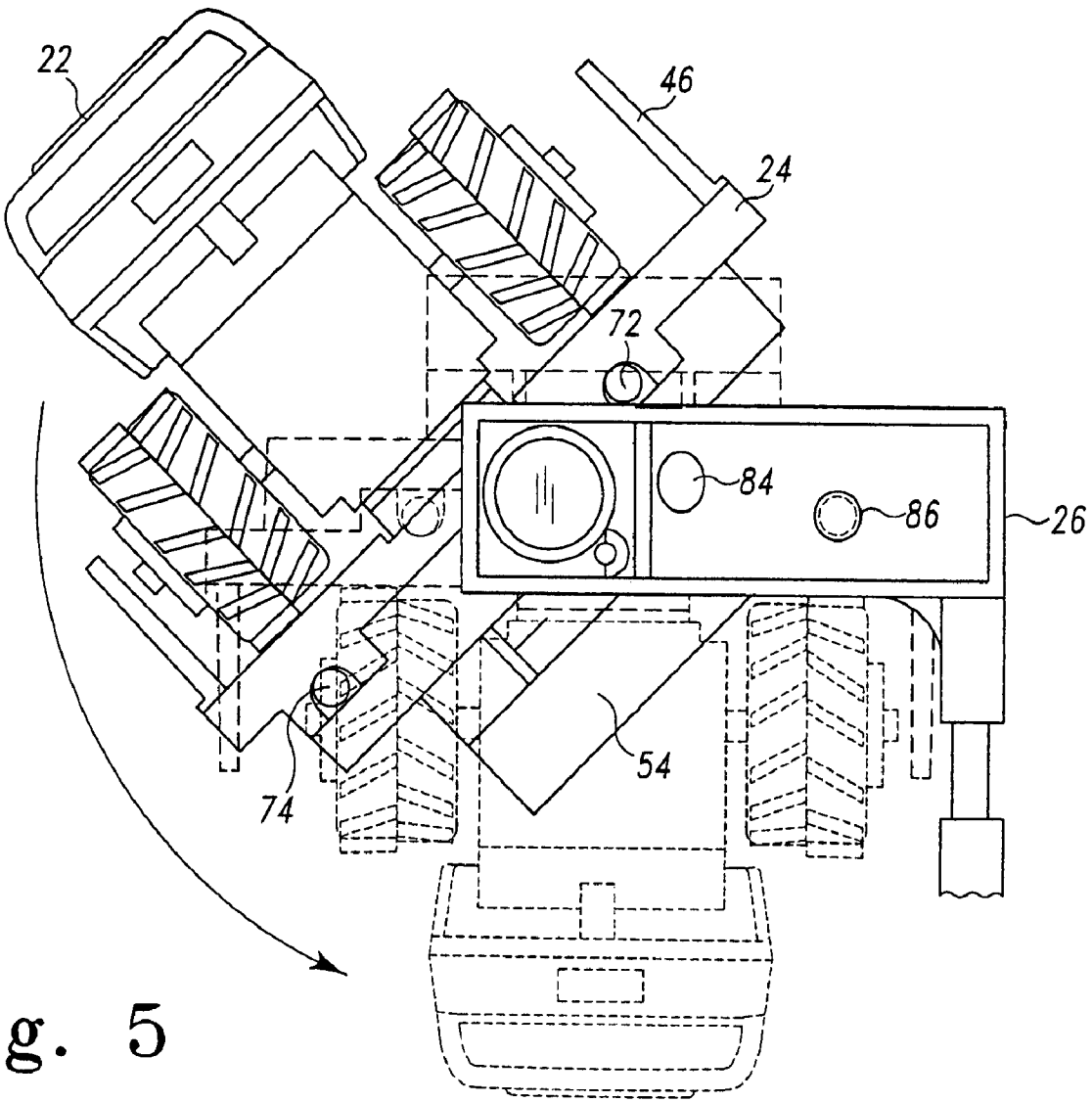
FIG. 5 is a trailing edge view of the platform of FIG. 3.

An inversion retention mechanism 29 may include a sliding assembly 67, a biasing mechanism 69, and detent mechanisms 73, 77. The sliding assembly 67 may include a magnet 60 slidably oriented in a magnetic strip 58 and a release member 68 slidably oriented in the platform assembly 24. The first magnet 60 may be attached to a tab 66 adapted to engage a release member 68. The release member 68 may contact a first detent mechanism 73. The first detent mechanism 73 may include a first detent member 72 which is adapted to interface with a first detent port 84 on the support structure 26 as shown in FIG. 5.

A biasing mechanism 69 may bias the release member 68 into a locking position wherein the first detent member 72 extends beyond the trailing edge of the platform assembly 24. The biasing mechanism 69 may include a second biasing member 70, such as a spring, and a first biasing housing 71. The first magnet 60 may move when a toy vehicle 22 moves above it on the vehicle support surface 49. Movement of the first magnet 60 from a first position to a second position may move tab 66 against the release member 68 and counteract the biasing force applied by second biasing member 70. The force applied by tab 66 against the release member 68 may overcome the biasing force and cause release member 68 to move from a locking position to a release position, thereby pulling the first detent member 72 out of the first detent port 84.

A second detent mechanism 77 may include a second detent member 74, a third biasing member 75, and a second biasing housing 79. The second detent mechanism 77 may be adapted to bias the second detent member 74 outward to engage a second detent port 86. The second detent mechanism 77 may provide sufficient biasing force to hold the platform assembly 24 weight while at rest, but insufficient biasing force to resist unbiasing the second detent member 74 as it contacts the support structure 26 during inversion. Optionally, the detent mechanisms 73, 77 and detent ports 84, 86 may be oriented on the leading edge of the platform assembly 24.

The arcing mechanism may include support structure 26 pivotally attached to a base 28 at an arc axis 42. The support structure 26 may have a height H1 exceeding the length L1 of the vehicle support surface 49. While the support structure height to platform length ratio may range from less than unity to more than unity, a ratio that exceeds unity provides for a reduced change in orientation for a given travel distance of the platform assembly 24. Additionally or alternatively, an increased arc length A1 may provide a user of the toy play set with more enjoyment. Accordingly, the arc length traveled by a platform assembly 24 may be greater than the length of the support structure 26.

Figure 6:
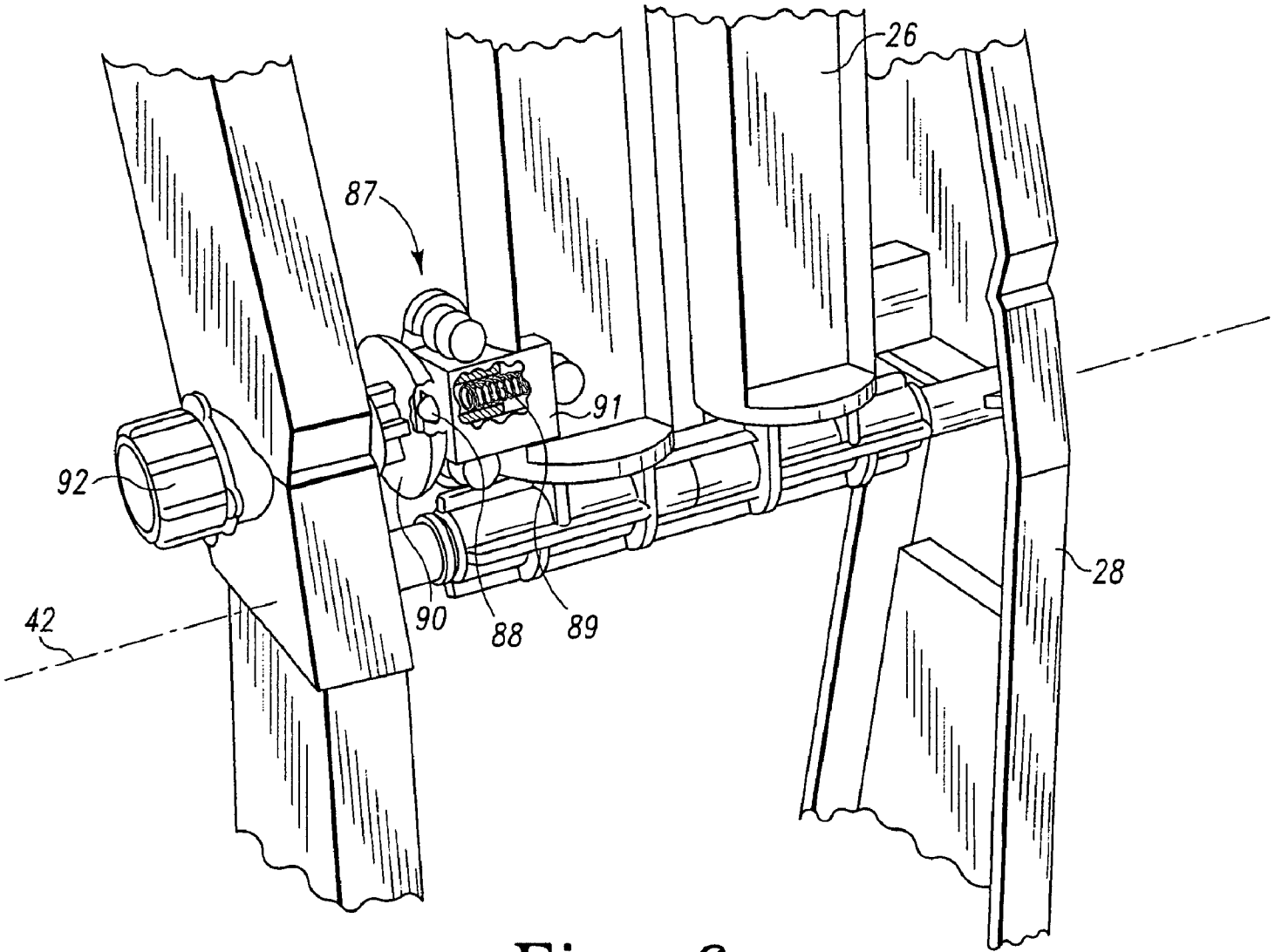
FIG. 6 is a perspective view of a support structure attached to a base of the toy play set of FIG. 1.

The arcing mechanism may include an arc retention mechanism 27. The arc retention mechanism 27 may include a locking mechanism 87 and a locking port 90. The locking mechanism 87 may include a locking member 88, a fourth biasing member 89, and a locking housing 91. The fourth biasing member 89 as depicted in FIG. 6. The locking member 88 may be adapted to interface with a locking port 90. The locking housing 91 may enclose the fourth biasing member 89 and partially enclose the locking member 88. The fourth biasing member 89, for example a spring, may bias the locking member 88 out of the locking housing 91. The fourth biasing member 89 may be selected to apply a biasing force to the locking member 88 sufficient to prevent the locking member 88 from retracting and disengaging from the locking port 90 due to the moment force created by weight of the platform 24. The fourth biasing member 89 may further be selected to apply a biasing force insufficient to stop the locking member 88 from retracting and disengaging from the locking port 90 when a toy vehicle 22 is positioned at the stop member 48 on the platform assembly 24. Accordingly, the presence of a toy vehicle 22 at the stop member 48 of the platform assembly may trigger arcing of the support structure 26 about the arc axis 42. The locking port 90 may be connected to a handle 92 and the pair may be adapted to rotate relative to the base 28.

Figure 9:
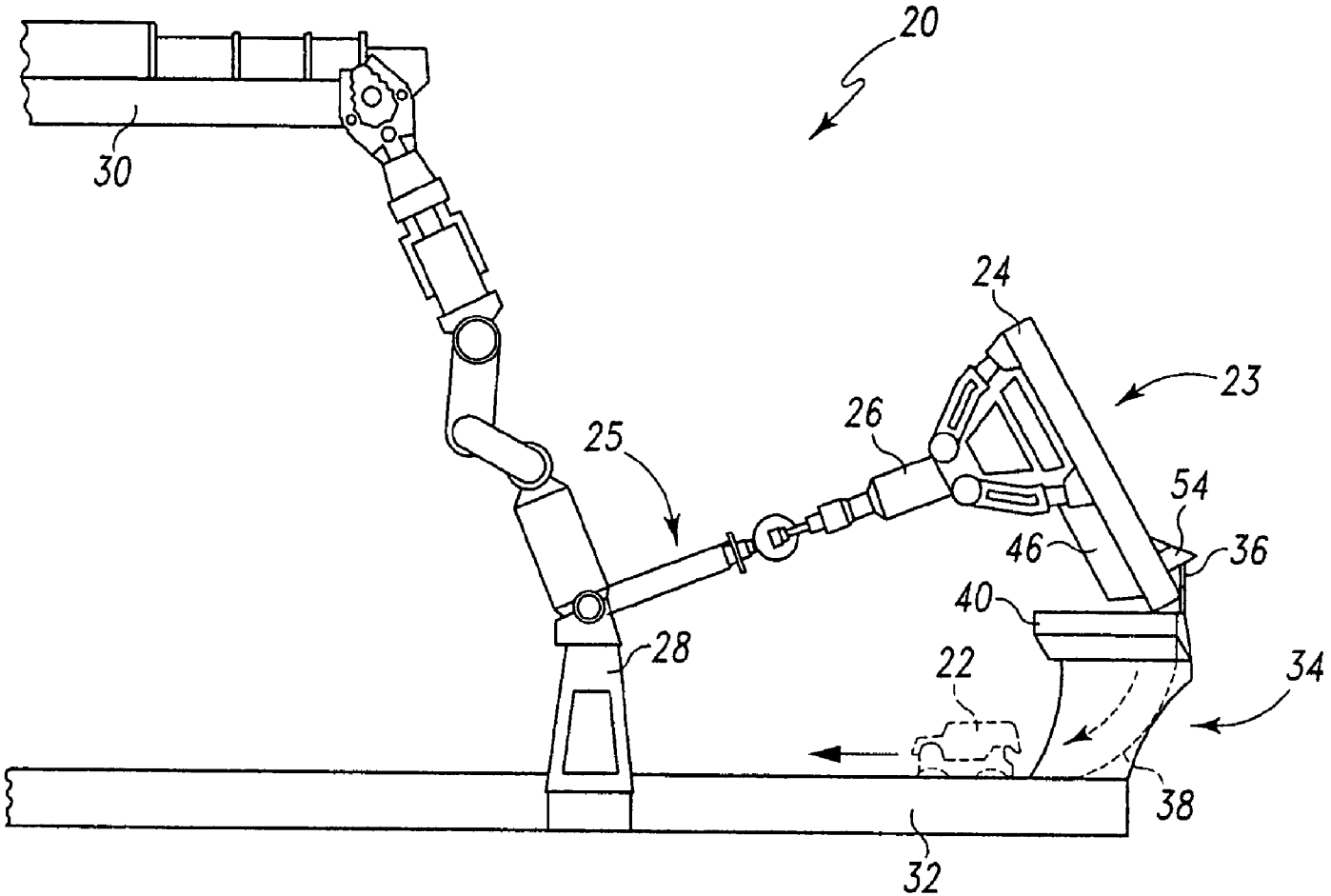
FIG. 9 is a side view of the toy play set of FIG. 7 in a fully pivoted position.

In some examples, toy play set 20 may include a stop member release activator 36. The stop member release activator 36 may interface with a stop member release 54 attached to the platform assembly 24. The stop member release 54 may be attached to a magnetic strip 58 pivotally attached to the platform assembly 24. In some examples, the stop member release 54 may be attached to the magnetic strip 58 on a side opposite a stop member 48. The stop member release activator 36 may interface with the stop member release 54 by contacting in a mating relationship. As depicted in FIG. 9, a stop member release activator 36 may project into the stop member release 61 and cause the stop member 48 to retract into the void 51 in the vehicle support surface 49. Retraction of the stop member 48 allows the toy vehicle 22 to travel off the vehicle support surface 49 on the platform assembly and toward a vehicle receiving apparatus 36.

A toy play set 20 may include a vehicle receiving apparatus 34 as depicted in FIG. 1. The vehicle receiving apparatus 34 may include a ramp 38 and a guide 40. The ramp 38 may include a vehicle support surface that curves from a top side of the vehicle receiving apparatus 34 to a bottom side. A guide 40 may form an aperture at the top of the vehicle receiving apparatus 34 through which a toy vehicle 22 can pass through to the ramp 38. In some examples a stop member release activator 36 may be attached to a vehicle receiving apparatus 34. Optionally, the stop member release activator 36 may project above the vehicle receiving apparatus 34.

A toy play set may include a first elongate track 30 and/or a second elongate track 32. The first elongate track 30 may include a first elongate track vehicle support surface and the second elongate track 32 may include a second track vehicle support surface. The first and second elongate tracks 30, 32 may lie at different heights. In some examples, the first elongate track 30 may reside at substantially the same height as the vehicle support surface 49 when the support structure 26 is oriented substantially vertical. Optionally, the first elongate track 30 may be oriented near the vehicle support surface 49 such that a toy vehicle 22 can travel from the first elongate track 30 to the vehicle support surface 49. In some examples, the second elongate track 32 may extend from a ramp 38 in a vehicle receiving apparatus 34 and be and be adapted to receive a toy vehicle 22 traveling down ramp 38.

Figure 7:
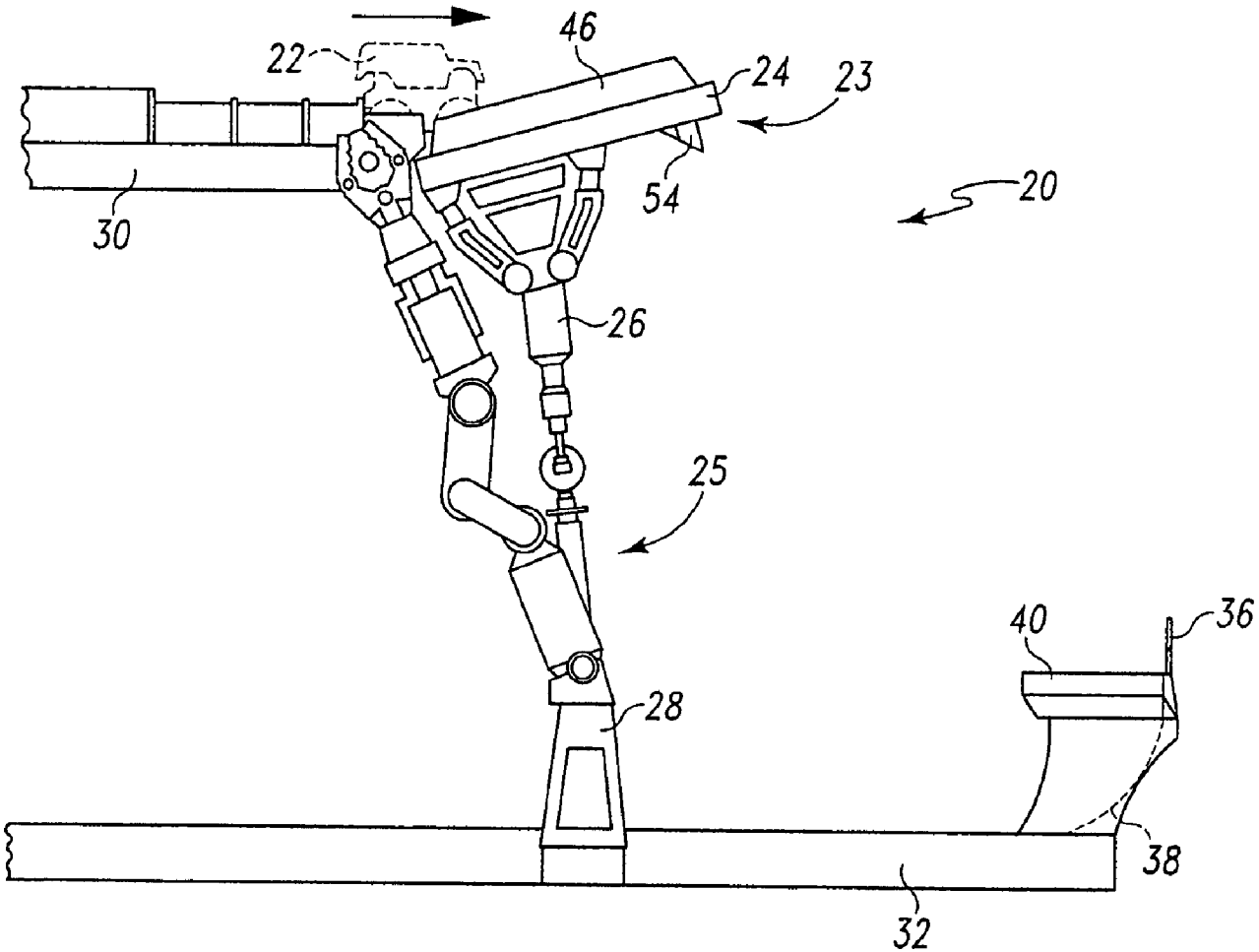
FIG. 7 is a side view of a toy play set with a toy vehicle thereon in an unpivoted position.
Figure 8:
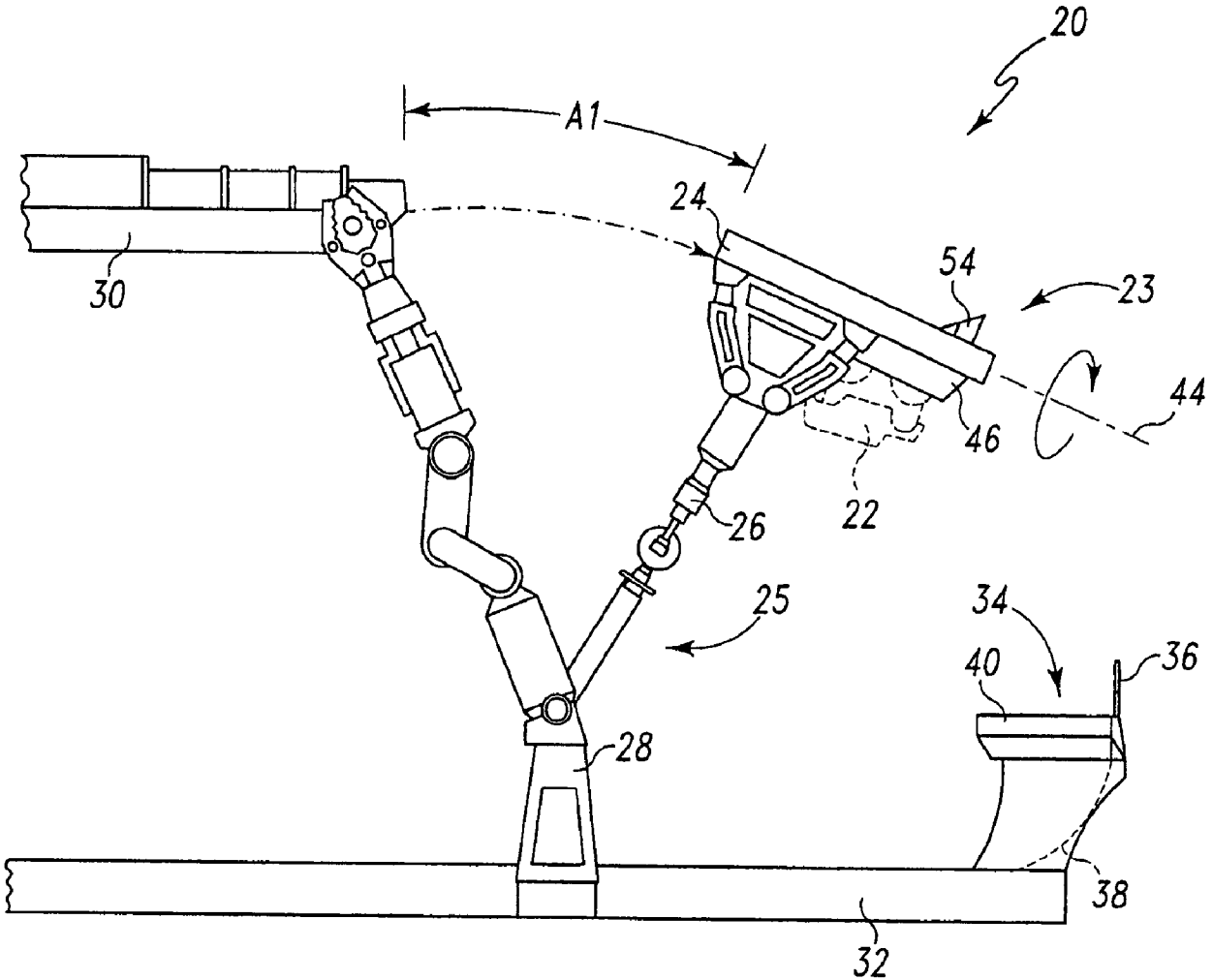
FIG. 8 is a side view of the toy play set of FIG. 7 pivoting about a pivot axis.

FIGS. 7-9 depict a toy vehicle 22 and one example of a toy play set 20 in multiple states of motion. In FIG. 7, a toy vehicle 22 travels from a first elongate track 30 to a platform assembly 24, which is in an upright position. In FIG. 8, the toy vehicle 22 has traveled across the platform assembly 24 to the stop member (not pictured). The vehicle's position on the platform assembly 24 has triggered the inversion mechanism 23 to invert the platform assembly 24 about the platform axis 44. The position of toy vehicle 22 on the platform assembly 24 has also triggered the arcing mechanism 25 to arc the platform assembly 24 about the arc axis 42. Accordingly, the platform assembly 24 and toy vehicle 22 are in inverted positions and arcing towards a vehicle receiving apparatus 34. In FIG. 9, when the stop member release 54 contacts the stop member release activator 36, the magnetic strip 58 pivots about hinge 71 (not pictured) causing the stop member 48 attached to the magnetic strip 58 to retract into the void 51 in the vehicle support surface 51. Retraction of the stop member 48 allows toy vehicle 22 to travel into the vehicle receiving apparatus 34 through guide 40 and down ramp 38. After leaving the vehicle receiving apparatus 34, the toy vehicle 22 may travel onto a second elongate track 32, which may be a different height than the first elongate track.

Another example of a toy play set 20 comprises a base 28, a support structure 26 pivotally attached to the base 28 and adapted to pivot about an axis perpendicular to a direction of travel of a toy vehicle, and a platform assembly 24 with a vehicle support surface 49, which defines the direction of travel, wherein the platform assembly 24 is attached to the support structure 26. In this example, platform assembly 24 may not rotate about a platform axis 44. The support structure 26 may pivot about an axis both perpendicular to the direction of travel and parallel to the ground. Further optional features in this example may include a first elongate track 30, a second elongate track 32, and a vehicle receiving apparatus 34.

A further example of a toy play set 20 comprises a support structure 26 and a platform 24 that includes a vehicle support surface 49, which defines a direction of travel for a toy vehicle 22, wherein the platform is pivotally attached to the support structure 26 and adapted to pivot about an axis parallel to the direction of travel. In this example, the support structure 26 may not pivot about a pivot axis 42 and the toy play set 20 may not include a base 28. The platform 24 may pivot about a platform axis both parallel to the direction of travel and parallel to the ground. Further optional features in this example may include a first elongate track 30, and a second elongate track 32.

While embodiments of a toy play set and methods of operating a toy play set have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed.

Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

Inventions embodied in various combinations and subcombinations of features, functions, elements, and/or properties may be claimed through presentation of claims in a related application. Such claims, whether they are directed to different inventions or directed to the same invention, whether different, broader, narrower or equal in scope to the other claims, are also regarded as included within the subject matter of the present disclosure.

What is claimed is:

1. A toy play set for use with a toy vehicle comprising:

a base;

a support structure pivotally attached to the base; and a platform assembly attached to the support structure and having a toy vehicle support surface having a length;

wherein the support structure is adapted to pivot relative to the base about an arc axis spaced from the platform assembly a distance exceeding the length of the toy vehicle support surface, and the platform assembly is adapted to rotate relative to the support structure about a platform axis oriented at an angle to the arc axis when viewed from a plane parallel to both the platform axis and the arc axis.

2. The toy play set of claim 1, wherein the platform assembly is further adapted to rotate relative to the support structure about a platform axis oriented substantially in line with a direction of travel of a toy vehicle on the vehicle support surface.

3. The toy play set of claim 2, wherein the platform assembly further comprises a gateway mechanism adapted to selectively retain a vehicle disposed on the vehicle support surface.

4. The toy play set of claim 3, wherein the gateway mechanism includes a barrier disposed in a travel path of a toy vehicle along the vehicle support surface, wherein the barrier is adapted to be selectively removed.

5. The toy play set of claim 4, wherein the gateway mechanism further comprises a stop member projecting into the travel path, wherein the stop member is movable between a stop position in which the stop member extends into the vehicle travel path and a passage position in which the stop member is retracted from the travel path.

6. The toy play set of claim 5, wherein the platform assembly further comprises a first biasing mechanism adapted to bias the stop member toward the stop position.

7. The toy play set of claim 6, wherein the platform assembly further comprises a first detent mechanism along a trailing edge of the platform assembly and a second detent mechanism along a trailing edge of the platform assembly, wherein the first detent mechanism and the second detent mechanism are each adapted to selectively stop rotation of the platform assembly at different points.

8. The toy play set of claim 7 wherein the first detent mechanism is adapted to interface with a first detent port on the support structure to stop rotation of the platform assembly and the second detent mechanism is adapted to interface with a second detent port on the support structure to stop rotation of the platform assembly.

9. The toy play set of claim 8, wherein the platform assembly further comprises a magnet slidably mounted to the platform assembly beneath the vehicle support surface when the platform is in an upright position, the magnet being adapted to interact with a toy vehicle including one or more magnetically attractable elements.

10. The toy play set of claim 9, wherein the platform assembly further comprises:

a release member slidably mounted to the platform assembly, wherein the release member couples with the first detent mechanism on one end and couples with the magnet slidably mounted to the platform assembly on another end; and a second biasing mechanism adapted to bias the release member in a locking position wherein the release member acts on the first detent mechanism to project a first detent member beyond the vehicle support surface periphery.

11. The toy play set of claim 2, wherein the platform assembly further comprises a metal strip in the vehicle support surface to interact with a toy vehicle including an element attracted to metal.

12. The toy play set of claim 2, wherein the support structure further comprises a locking mechanism adapted to interface with a locking port on the base to selectively prevent arcing of the platform assembly about the arc axis.

13. The toy play set of claim 12, wherein the locking mechanism includes a locking member, a locking housing, and a biasing member adapted to extend the locking member beyond the locking housing to engage the locking port.

14. The toy play set of claim 13, wherein the locking port is rotatably mounted to the base to selectively rotate the locking port relative to the base to engage the locking mechanism at different points along the arc defined by rotation of the locking mechanism attached to the support structure relative to the base.

15. The toy play set of claim 5 comprising further a stop member release attached to the platform assembly and oriented on a side of the platform assembly opposite of the vehicle support surface.

16. The toy play set of claim 15 comprising further a stop member release activator adapted to engage the stop member release and retract the stop member to allow a toy vehicle to travel along the vehicle support surface.

17. The toy play set of claim 16 further comprising:

a first elongate track having a toy vehicle-support surface positioned at a first height, the first elongate track having a terminal end oriented near the platform assembly when the platform assembly is in a first position along an arc, such that a toy vehicle can move from the first elongate track to the platform assembly; and a second elongate track having a toy vehicle-support surface positioned at a second height, the second elongate track having a terminal end oriented near the platform assembly when the platform assembly is in a second position along an arc, such that a toy vehicle can move from the platform assembly to the second elongate track.

18. The toy play set of claim 17 further comprising a vehicle receiving apparatus comprising:

a guide defining an aperture configured to receive a toy vehicle at the top of the vehicle receiving apparatus; and a ramp having a vehicle support surface extending from the guide to the second elongate track.

19. The toy play set of claim 17, wherein the stop member release activator is attached to the vehicle receiving apparatus.

20. A toy play set for use with a toy vehicle comprising:

A) a support structure; and

B) a platform assembly rotatably mounted to the support structure, the platform assembly comprising:

a) a toy vehicle support surface defining a toy vehicle's direction of travel, wherein the platform assembly is adapted to rotate about an axis at least partially in line with the direction of travel between a first position in which the toy vehicle support surface is facing a first direction and a second position in which the toy vehicle support surface is facing a second direction different than the first direction, b) a gateway mechanism adapted to selectively retain a toy vehicle disposed on the toy vehicle support surface, the gateway mechanism including:

i) a barrier disposed in a travel path of a toy vehicle along the toy vehicle support surface, wherein the barrier is adapted to be selectively removed, and ii) a stop member projecting into the travel path, wherein the stop member is movable between a stop position in which the stop member extends into the travel path and a passage position in which the stop member is retracted from the travel path, and c) a first biasing mechanism adapted to bias the stop member toward the stop Dosition.

d) a first detent mechanism along a trailing edge of the platform assembly, and e) a second detent mechanism along the trailing edge of the platform assembly, wherein the first detent mechanism and the second detent mechanism are each adapted to selectively stop rotation of the platform assembly at different points.

21. The toy play set of claim 20 wherein the first detent mechanism is adapted to interface with a first detent port on the support structure to stop rotation of the platform assembly and the second detent mechanism is adapted to interface with a second detent port on the support structure to stop rotation of the platform assembly.

22. The toy play set of claim 21, wherein the platform assembly further comprises a magnet slidably mounted to the platform assembly beneath the vehicle support surface when the platform is in an upright position, the magnet being adapted to interact with a toy vehicle including one or more magnetically attractable elements.

23. The toy play set of claim 22, wherein the platform assembly further comprises:

a release member slidably mounted to the platform assembly, wherein the release member couples with the first detent mechanism on one end and couples with the magnet slidably mounted to the platform assembly on another end; and a second biasing mechanism adapted to bias the release member in a locking position wherein the release member acts on the first detent mechanism to project a first detent member beyond the vehicle support surface periphery.

24. The toy play set of claim 20, wherein the platform assembly further comprises a metal strip in the vehicle support surface to interact with a toy vehicle including an element attracted to metal.

25. The toy play set of claim 20 further comprising:

a first elongate track having a vehicle support surface defining a first plane substantially in line with the plane defined by the vehicle support surface when the platform assembly is in an upright position, wherein the first elongate track is oriented near the platform assembly such that a toy vehicle can move from the first elongate track to the platform assembly when the platform assembly is in an upright position; and a second elongate track having a vehicle support surface defining a second plane substantially in line with the plane defined by the vehicle support surface when the platform assembly is in an inverted position, wherein the second elongate track is oriented near the platform assembly such that a toy vehicle can move from the platform assembly to the second elongate track when the platform assembly is in an inverted position.

26. The toy play set of claim 20, wherein the first direction faces away from the support structure and the second direction faces toward the support structure.

27. The toy play set of claim 20, wherein the first direction is opposite the second direction.

* * * * *